US011014147B2

(12) United States Patent
Spatz et al.

(10) Patent No.: US 11,014,147 B2
(45) Date of Patent: May 25, 2021

(54) APPARATUS AND METHOD OF MANUFACTURING METALLIC OR INORGANIC FIBERS HAVING A THICKNESS IN THE MICRON RANGE BY MELT SPINNING

(71) Applicant: Max-Planck-Gesellschaft zur Foerderung der Wissenschaften e.V., Munich (DE)

(72) Inventors: Joachim Spatz, Stuttgart (DE); Alexandre Micoulet, Mannheim (DE); Elham Sharifikolouei, Stuttgart (DE)

(73) Assignee: Max-Planck-Gesellschaft zur Foerderung der Wissenschaften e.V., Munich (DE)

( * ) Notice: Subject to any disclaimer, the term of this patent is extended or adjusted under 35 U.S.C. 154(b) by 347 days.

(21) Appl. No.: 15/579,536

(22) PCT Filed: Sep. 6, 2016

(86) PCT No.: PCT/EP2016/070963
§ 371 (c)(1),
(2) Date: Dec. 4, 2017

(87) PCT Pub. No.: WO2017/042155
PCT Pub. Date: Mar. 16, 2017

(65) Prior Publication Data

US 2018/0178275 A1 Jun. 28, 2018

(30) Foreign Application Priority Data

Sep. 11, 2015 (EP) ..... 15184903

(51) Int. Cl.
*B22D 11/06* (2006.01)
*B22D 11/16* (2006.01)

(52) U.S. Cl.
CPC ..... *B22D 11/0611* (2013.01); *B22D 11/0642* (2013.01); *B22D 11/0651* (2013.01); *B22D 11/16* (2013.01)

(58) Field of Classification Search
CPC . B22D 11/00; B22D 11/0611; B22D 11/0642; B22D 11/0651; B22D 11/0682; B22D 11/16
See application file for complete search history.

(56) References Cited

U.S. PATENT DOCUMENTS 2,825,108 A 3/1958 Pond
2,825,198 A 3/1958 Pond
(Continued)

FOREIGN PATENT DOCUMENTS

EP 0 055 827 A1 7/1982
EP 2 982 460 A1 2/2016
(Continued)

OTHER PUBLICATIONS

Thiele, Uwe et al., "Dewetting of an Evaporating Thin Liquid Film: Heterogeneous Nucleation and Surface Instability", Physical Review Letters, vol. 80, No. 13, pp. 2869-2872, Mar. 30, 1998.
(Continued)

*Primary Examiner* — Kevin P Kerns
*Assistant Examiner* — Steven S Ha
(74) *Attorney, Agent, or Firm* — Kilpatrick Townsend & Stockton LLP

(57) ABSTRACT

Disclosed is an apparatus having a rotatable wheel with a planar external circumferential surface, which is flat in a direction parallel to the axis of rotation of the wheel, at least one nozzle having a nozzle opening for directing a molten metal onto the circumferential surface and a collection means for collecting solidified fibers of metal formed on the circumferential surface from the molten metal and separated
(Continued)

Figure 2:
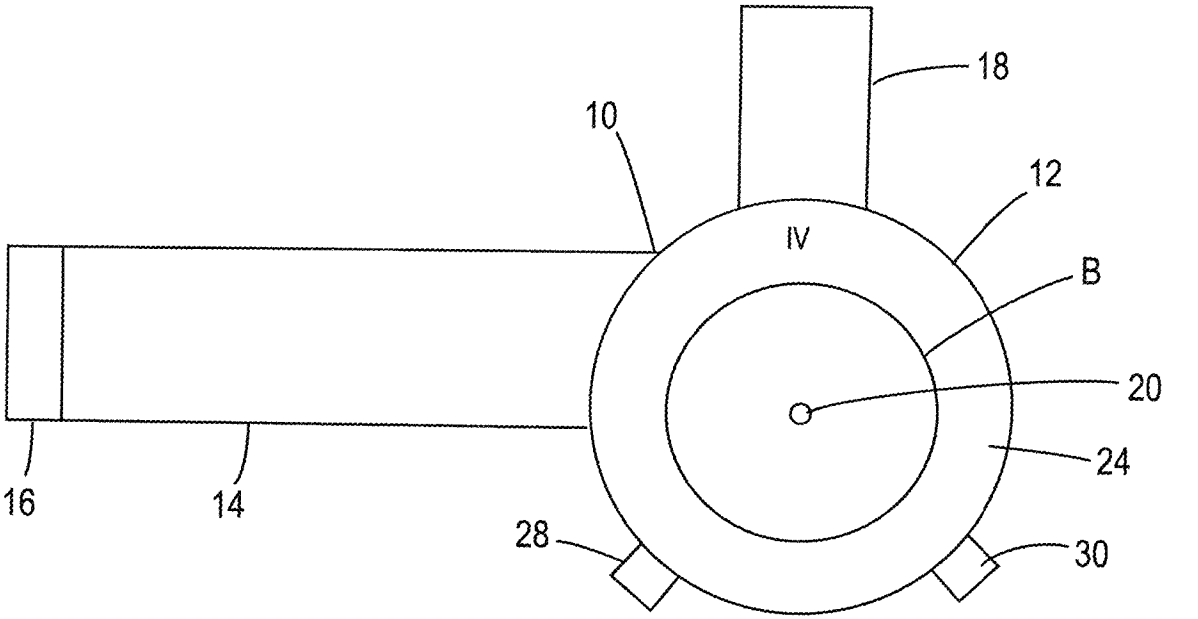

from the circumferential surface by centrifugal force generated by rotation of the wheel. The nozzle has a rectangular cross-section having a width of the nozzle opening in the circumferential direction of rotation of the wheel and a length transverse to the circumferential surface of the wheel which is greater than the width. An apparatus is provided for controlling a gas pressure applied to the liquid metal and delivers it to the circumferential surface of the rotatable wheel.

16 Claims, 8 Drawing Sheets

(56) References Cited

U.S. PATENT DOCUMENTS

| | | | | |
|---|---|---|---|---|
| 2,910,724 | A | 11/1959 | Grajeck | |
| 2,910,744 | A | 11/1959 | Pond | |
| 2,976,590 | A | 3/1961 | Pond | |
| 4,454,908 | A * | 6/1984 | Kodama | B22D 11/0602 164/413 |
| 4,523,966 | A * | 6/1985 | Tsuya | C30B 11/00 438/490 |
| 5,096,513 | A * | 3/1992 | Sawa | B22D 11/0611 148/304 |
| 5,213,151 | A | 5/1993 | Hackman | |
| 6,626,228 | B1 | 9/2003 | Bewlay et al. | |
| 2015/0027592 | A1* | 1/2015 | Shibasaki | B22D 11/10 148/403 |
| 2017/0209918 | A1 | 7/2017 | Spatz et al. | |

FOREIGN PATENT DOCUMENTS

| | | | |
|---|---|---|---|
| JP | H0655247 | A | 3/1994 |
| JP | 2000-42694 | A | 2/2000 |

OTHER PUBLICATIONS

Herminghaus, Stephan et al., "Spinodal Dewetting in Liquid Crystal and Liquid Metal Films," Science, vol. 282, pp. 916-919, Oct. 30, 1998.

Egami, T., "Magnetic amorphous alloys: physics and technological applications", Reports on Progress in Physics, vol. 47, No. 12, Rep. Prog. Phys. 47, 1601, https://doi.org/10.1088/0034-4885/47/12/002, Dec. 1984.

Liebermann H. H., et al., "The dependence of the Geometry of Glassy Alloy Ribbons on the Chill Block Melt-spinning Process Parameters", Materials Science Engineering, Elsevier Sequoia, Lausanne, Netherlands, vol. 43, No. 3, May 1, 1980, pp. 203-210, XP024085093, ISSN: 0025-5416, https://doi.org/10.2016/0025-5416(80)90103-2.

Liebermann H. H., et al., "Production of amorphous alloy ribbons and effects of apparatus parameters on ribbon dimensions", IEEE Transaction on Magnetics, IEEE Service Center, New York, US, vol. 12, No. 6, Nov. 1, 1976, pp. 921-923, XP002745621, ISSN: 0018-9464, https://doi.org/10.1109/TMAG.1976.1059201.

Jassim, Ahmed K., et al., "Sustainable Manufacturing Process for Bulk Metallic Glasses Production Using Rapid Solidification with Meld Spinning Technique", Proceedings of 2014 International Conference on Material Science and Material Engineering (MSME 2014); Mar. 15-16, 2014, Chicago, IL USA, Mar. 15, 2014, pp. 1-12, XP002754864, ISBN: 978-1-60595-171-3.

Jech, Robert W. et al, "Rapid Solidification via Melt Spinning: Equipment and Techniques", Journal of Metals, Springer-Verlag, New York, vol. 36, No. 4, Dec. 20, 2013, pp. 41-45, XP035303445, ISSN: 0148-6608, https://doi.org/10.1007/BF03338425.

Sung, J. K. et al, "Theoretical expectation of strip thickness in planar flow casting process", Material Science and Engineering, vol. A181-A182, Jan. 1, 1994, pp. 1237-1242, XP002754863, ISSN: 0921-5093, https://doi.org/10.2016/0921-5093(94)90838-9.

Kim, S. W. et al., "Manufacture and Industrial Application of Fe-based Metallic Glasses", Materials Science Forum, Trans Tech Publications Ltd., Switzerland, vol. 706-709, Jan. 1, 2012, pp. 1324-1330, XP002754862, ISSN: 0255-5476, https://doi.org/10.4028/www.scientific.net/msf.706-709.1324.

Cahn, R. W., "Physical Metallurgy", Third edition, Elsevier Science Publishers B. V., 1983; Link to pdf: http://allaboutmetallurgy.com/wp/wp-content/uploads/2017/04/Physical%20Metallurgy.pdf (pp. 1-pp. 3010).

International Search Report and Written Opinion of the International Searching Authority in corresponding application PCT/EP2016/070963, dated Nov. 17, 2016, (six pages).

European Search Report of corresponding European Patent Application No. 15184903.1 dated Mar. 16, 2016 (five pages).

Office Action from related Korean Application No. 10-2017-7035516 and English translation dated Jan. 28, 2019 (11 pages).

Sung, J.K., et al., "Theoretical expectation of strip thickness in planar flow casting process," Research Institute of Industrial Science and Technology, Pohang, Kyung-Buk (South Korea), Elsevier Sequioa, Materials Science and Engineering, A181/A182 (1994) pp. 1237-1242.

* cited by examiner

Fig. 1
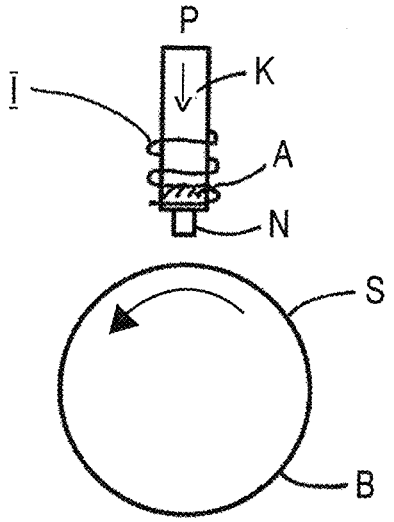
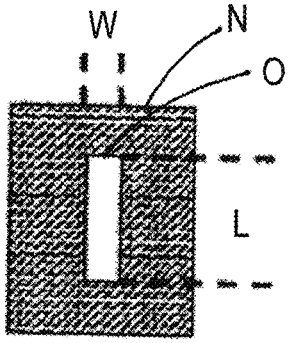
Fig. 4

Fig. 6

| Examples/ exp. # | material | wheel surface | nozzle slit width (μm) | wheel surface speed (m/s) | pressure difference (mbar) | presuure in the chamber (mbar) | median width (μm) | mean (μm) | SD (μm) | max. fiber width (μm) | min. fiber width (μm) | fiber ticknes s (μm) | ejection temperatu re (°C) | Mf (mass of fiber (g/sec)) |
|---|---|---|---|---|---|---|---|---|---|---|---|---|---|---|
| 1/MS | $Fe_{40}Ni_{40}B_{20}$ | flat | 400 | 18.8 | 200 | 400 | flat ribbon 1cm in width | | | | | < 40 | 1350 | < 100 |
| 2/48 | $Fe_{40}Ni_{40}B_{20}$ | flat | 400 | 59.4 | 200 | 400 | 137.3 | < 5 | 216.2 | 1296.0 | 6.3 | < 5 | 1400 | < 5 |
| 3/47 | $Fe_{40}Ni_{40}B_{20}$ | flat | 200 | 59.4 | 200 | 400 | 41.1 | < 5 | 65.7 | 335.9 | 3.0 | < 5 | 1400 | < 5 |
| 4/45 | $Fe_{40}Ni_{40}B_{20}$ | flat | 100 | 59.4 | 400 | 400 | 24.8 | < 5 | 46.9 | 216.1 | 3.1 | < 5 | 1400 | < 5 |
| 5/51 | $Fe_{40}Ni_{40}B_{20}$ | flat | 75 | 59.4 | 600 | 400 | 17.5 | < 5 | 23.5 | 94.0 | 2.3 | < 5 | 1400 | < 5 |
| 6/50 | $Fe_{40}Ni_{40}B_{20}$ | flat | 50 | 59.4 | 1000 | 400 | 15.8 | < 5 | 22.3 | 148.3 | 2.7 | < 5 | 1400 | < 5 |
| 7/49 | $Fe_{40}Ni_{40}B_{20}$ | flat | 25 | 59.4 | 1500 | 400 | 14.8 | < 5 | 24.5 | 180.7 | 2.1 | < 5 | 1400 | < 5 |
| 8/58 | stainless steel | flat | 75 | 59.4 | 800 | 400 | 22.0 | < 5 | 31.7 | 143.9 | 2,3 | < 5 | 1550 | < 5 |
| 9/41 | $Fe_{40}Ni_{40}B_{20}$ | flat | 50 | 53.1 | 1000 | 400 | 12.1 | < 5 | 9.0 | 52.2 | 7.1 | < 5 | 1350 | < 5 |
| 10/42 | $Fe_{40}Ni_{40}B_{20}$ | flat | 50 | 53.1 | 1000 | 400 | 17.4 | < 5 | 22.5 | 211.0 | 2.5 | < 5 | 1350 | < 5 |
| 11/43 | $Fe_{40}Ni_{40}B_{20}$ | flat | 50 | 53.1 | 1500 | 400 | 14.6 | < 5 | 19.8 | 97.6 | 2.8 | < 5 | 1378 | < 5 |
| 12/44 | $Fe_{40}Ni_{40}B_{20}$ | flat | 75 | 53.1 | 600 | 400 | 23.5 | < 5 | 27.9 | 138.8 | 3.2 | < 5 | 1352 | < 5 |
| 13/45 | $Fe_{40}Ni_{40}B_{20}$ | flat | 100 | 53.1 | 400 | 400 | 24.8 | < 5 | 46.9 | 216.1 | 3.1 | < 5 | 1400 | < 5 |
| 14/46 | $Fe_{40}Ni_{40}B_{20}$ | flat | 50 | 62.5 | 1500 | 400 | 12.5 | < 5 | 24.6 | 159.1 | 0.8 | < 5 | 1400 | < 5 |
| 15/54 | Zn | flat | 50 | 59.4 | 1000 | 400 | - | < 5 | - | 1000.0 | - | < 5 | 700 | < 5 |
| 16/56 | Al | flat | 50 | 59.4 | 1000 | 400 | - | < 5 | - | 1000.0 | - | < 5 | 800 | < 5 |

MS050

MS049

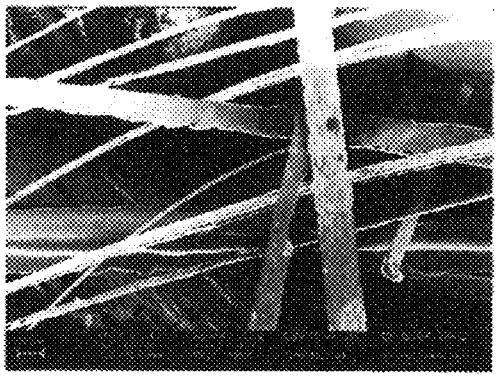
MS046 SEM-198x
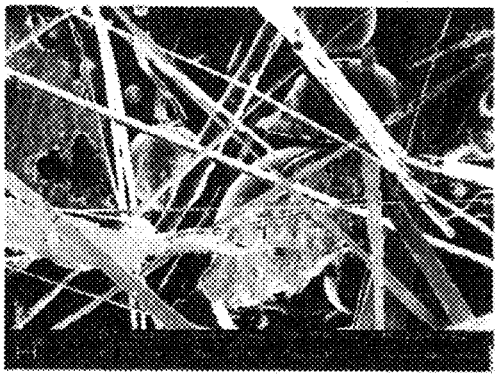
MS046 SEM-201x
FIG. 13

APPARATUS AND METHOD OF MANUFACTURING METALLIC OR INORGANIC FIBERS HAVING A THICKNESS IN THE MICRON RANGE BY MELT SPINNING

This application is a U.S. National Phase Application of PCT/EP2016/070963, filed Sep. 6, 2016, which claims priority to European Patent Application No. 15184903.1, filed Sep. 11, 2015, the entireties of which are incorporated by reference herein.

Melt spinning is a technique used for the rapid cooling of liquids. A wheel may be cooled internally, usually by water or liquid nitrogen, and rotated. A thin stream of liquid is then dripped onto the wheel and cooled, causing rapid solidification. This technique is used to develop materials that require extremely high cooling rates in order to form elongate fibers of materials such as metals, inorganic materials and metallic glasses. The cooling rates achievable by melt-spinning are of the order of $10^4$-$10^7$ kelvin per second (K/s).

The first proposals for melt spinning originated with Robert Pond in a series of related patents from 1958-1961 (U.S. Pat. Nos. 2,825,108, 2,910,744, and 2,976,590). In U.S. Pat. Nos. 2,825,198 and 2,910,724 a molten metal is ejected through a nozzle under pressure onto a rotating smooth concave surface of a chill block. By varying the surface speed of the chill block and the ejection conditions it is said to be possible to form metal filaments with a minimum cross sectional dimension of 1 μm to 4 μm and lengths from 1 μm to infinity. In U.S. Pat. No. 2,824,198 a single chill block is used, in U.S. Pat. No. 2,910,724 a plurality of nozzles direct flows of metal onto one rotating chill block or a plurality of rotating chill blocks and associated nozzles are provided. In U.S. Pat. No. 2,910,724 no chill block is provided, instead the molten metal is ejected downwardly through nozzles into a vertically disposed cooled chamber containing solid carbon dioxide on ledges provided at the side wall of the chamber. By varying the cross sectional shape of the nozzles the cross-sectional shape of the filaments produced can be varied.

The current concept of the melt spinner was outlined by Pond and Maddin in 1969. Although, liquid was, at first, quenched on the inner surface of a drum, Liebermann and Graham further developed the process as a continuous casting technique by 1976, this time on the drum's outer surface.

The process can continuously produce thin ribbons of material, with sheets several inches in width being commercially available. The dimensions of the bands normally amount to several tens of microns thickness and several centimeters in width and length References to this process can be found in the following publications:

1. R. W. Cahn, Physical Metallurgy, Third edition, Elsevier Science Publishers B. V., 1983.
2. Liebermann, H.; Graham, C. (November 1976). "Production of amorphous alloy ribbons and effects of apparatus parameters on ribbon dimensions". IEEE Transactions on Magnetics 12(6): 921-923. doi: 10.1 I09/TMAG.1976.I05920I.
3. Egami, T. (December 1984). "Magnetic amorphous alloys: physics and technological applications". Reports on Progress in Physics 47 (12): 1601.doi: 10.1088/0034-4885/47/12/002.

The melt spinning process has hitherto not been used for the commercial manufacture of micron scale metallic ribbons and fibers on an industrial scale.

In this connection it should be noted that a fiber can be understood as an element of which the length is at least twice its width.

A method of manufacturing microfibers from a metallic melt by depositing the melt on a rotating wheel is described in our as yet unpublished EP application 14 180 273,6 and in the corresponding PCT application PCT/EP2015/068194. There the wheel is provided with a structured surface which modulates the dimensions of the metallic microfibers that are produced.

Metal fiber reinforced composite materials play a central role in a whole series of applications for the improvement of the most diverse properties. Examples of such applications are:

- Electrodes for batteries and accumulators,
- Conductive plastics for touch sensitive systems such as displays and artificial hands in the field of robots,
- Anti-electrostatic textiles and plastics,
- Mechanically reinforced textiles, plastics and cement for lightweight and heavy construction,
- Filter materials for use in environments subjected to mechanical and/or chemical stress
- Catalysis An important aspect for the improvement of fiber based material functions is a large surface area to weight ratio of the metal fibers and the ability to manufacture and process them in an industrially relevant process. This signifies:

- low widths and adjustable lengths of the metal fibers,
- control of the fiber adhesion for the further processing of the fibers,
- applicable to different materials
- economic manufacturing method and low process costs with a high material yield per unit time, Nowadays, the industrially relevant manufacture of functional materials based on metal fibers is restricted to fiber thicknesses of >50 μm. Academic processes exist based on lithographic techniques, glass based template methods and mechanical extrusion processes which enable metallic fibers of <50 μm to be achieved. These methods cannot however be utilized industrially because they are restricted to a few materials and in some cases are not repeatable.

The method and apparatus described in our EP application 14 180 273,6 and in the corresponding PCT application PCT/EP2015/068194 permit the production of micron sized fibers on an industrial scale. However, the need to provide the rotating wheel with a relatively fine and highly precise surface design or topography is a substantial complication and a substantial cost factor in an industrial process.

Further prior art can be found in the following documents: EP 0 055 827 A1, the publication by S. W. Kim et al. titled "Manufacture and Industrial application of Fe-based Metallic Glasses", published in the Materials Science Forum, in volume 706-709, 2012 on pages 1324 to 1330, the publication by J. K. Sung et al. titled "Theoretical expectations of strip thickness in planar flow casting process", published in Materials Science and Engineering, volumes A181-A182, 1994 on pages 1237-1242, and the publication by Jech Robert et al. titled: "Rapid Solidification via melt spinning: Equipment and techniques", published in Journal of Metals, volume 36, no. 4 on Dec. 20, 2013 on pages 41-45.

The object of the present invention is to provide an apparatus and a method by which metallic and more generally inorganic microfibers can be generated on an external surface of a rotating wheel, with the microfibers having a homogenous distribution in the thickness of the fibers and a controllable width having a median value in the range from 200 nm to 50 μm as well as a length of 100 mm to centimeters or longer by depositing the melt onto a rapidly rotating metal or ceramic wheel having a smooth planar surface. The fibers should preferably have a thickness and width of less than one micron and a length of 0.5 mm to 5 mm or larger.

In order to satisfy this object there is provided apparatus for producing elongate fibers of metal, of metallic glasses or of inorganic material, the apparatus comprising a rotatable wheel having a planar external circumferential surface, which is flat in a direction parallel to the axis of rotation of the wheel, at least one nozzle having a nozzle opening for directing a molten material onto the circumferential surface, with the nozzle having a rectangular cross section and a width of a slit of the nozzle opening in the circumferential direction of the wheel being selected to lie in the range from 10 to 500 μm and a collection means for collecting solidified fibers of material formed on the circumferential surface from the molten material and separated from the circumferential surface by centrifugal force generated by rotation of the wheel, wherein the apparatus comprises a further apparatus that is configured to control a gas pressure applied to the molten material which moves the molten material through the nozzle opening and delivers it to the circumferential surface of the rotatable wheel and wherein the further apparatus is further configured to regulate the mass flow of molten material down to a level at which microfibers of the material are formed on the rotatable wheel by controlling and keeping the mass flow per unit area of the wheel surface of the molten material which is deposited per unit of area onto the circumferential surface of the rotatable wheel in the range from 0.01 to 100 g/m2*sec for a surface speed of rotation of the wheel in the range from 10 to 100 m/sec.

The nozzle conveniently has a rectangular cross-section having a width of the nozzle opening in the circumferential direction of rotation of the wheel and a length transverse to the circumferential surface of the wheel which is greater than the width, however this is not essential and the nozzle can in principle be manufactured with the most diverse cross-sectional shapes provided the dimensions and geometry of the nozzle opening permit the flow of molten metal through the opening to be regulated down to a level at which the desired microfibers are produced. As a further example the nozzle could have a crescent shaped opening, or could comprise a row of interconnected generally circular or elliptical or rectangular openings or a row of discrete circular or elliptical or rectangular openings, the row in each case being disposed parallel to the axis of rotation of the wheel or at an angle to the axis of rotation of the wheel. References to the width of the nozzle slit can then be understood as the width or the average width of the circular, elliptical or rectangular openings in a direction parallel to the direction of surface rotation of the wheel.

It should be noted in this connection that the prior art cited in the introduction to the specification does not show that the currently described nozzle widths can produce the desired fibers and that the desired fibers can be produced at the wheel speed ranges respectively at ranges of the surface speed of rotations of the wheel described herein.

The present invention also relates to a method for producing elongate microfibers of metal, or metallic glasses or of inorganic material having a median width of 50 μm or less, a thickness of 5 μm or less and a length at least ten times greater than said width, the method comprising the steps of directing a molten material through a nozzle onto a planar external circumferential surface of a rotating wheel, with the nozzle having a nozzle opening for directing a molten material onto the circumferential surface, with the nozzle having a rectangular cross section and a width of a slit of the nozzle opening in the circumferential direction of the wheel being selected to lie in the range from 10 to 500 μm, by applying a gas pressure to the molten material to move it through the nozzle opening and deliver it to the circumferential surface of the rotatable wheel, and collecting solidified fibers formed on the circumferential surface from the molten material and separated from the circumferential surface by centrifugal force generated by rotation of the wheel, the method further comprising the steps of selecting the dimensions and geometry of the nozzle in combination with the gas pressure (ΔP) to regulate the mass flow of molten material (Mfa) which is deposited per unit of area onto the circumferential surface of the rotatable wheel to a value in the range from 0.1 to 100 g/(m2*sec), especially between 0.5 and 50 g/(m2*sec), particularly between 0.7 and 30 g/(m2*sec) and ideally around 1 g/(m2*sec) for a surface speed of rotation of the wheel in the range from 10 to 100 m/sec to form microfibers of the material on the rotatable wheel by reducing the flow of molten material onto the circumferential surface of the wheel in a material dependent manner to a level at which it is concentrated by the forces that are acting to produce the desired elongate fibers of the material.

The flow of material is reduced to a level at which the elongate fibers have a width of 200 μm to <1 μm, preferably of 150 μm to <1 μm and especially of <50 μm to <1 μm. This means that the volume of liquid material Vm which is deposited per unit of area onto the circumferential surface of the rotatable wheel is controlled. The metal strands or fibers thereby produced typically have a thickness of less than or equal to 5 μm to <1 μm.

The length of the fibers is controlled by including grooves or elevations of 5 mm to 1 mm on top of the wheel surface onto which the melt is deposited. The grooves or elevations run parallel to the rotation axis with distances between the grooves and elevations which correspond to the length of the fibers. Practically, these grooves and elevations can be prepared by mechanical machining.

The underlying concept of the invention can be seen from the following calculations based on experimental results:

The quantity of the metallic melt deposited per second (Mf) lies between 0.01 and 10 g/sec; especially between 0.1 and 5 g/sec, particularly between 0.2 and 3 g/sec and ideally around 0.25 g/sec.

The speed of rotation of the wheel surface (U) typically lies between 10 and 100 m/sec; especially between 30 and 80 m/sec, ideally at 60 m/sec.

The mass flow per unit area=Mfa can be calculated as follows, when the speed of rotation of the surface of the wheel is U (m/sec) and the length of the nozzle opening is Ld:

Mf=0.01 g/sec; U=10 m/sec, Ld=1 cm: Mfa=Mf/(U*Ld*sec)=0.1 g/(m2*sec)

Mf=10 g/sec; U=100 m/sec, Ld=1 cm: Mfa=Mf/(U*Ld*sec)=10 g/(m2*sec)

Mf=10 g/sec; U=10 m/sec, Ld=1 cm: Mfa=Mf/(U*Ld*sec)=100 g/(m2*sec)

Mf=0.01 g/sec; U=100 m/sec, Ld=1 cm: Mfa=Mf/(U*Ld*sec)=0.01 g/(m2*sec)

Thus Mfa ranges between 0.01 and 100 g/(m2*sec); ideally at 0.42 g/(m2*sec) for U=60 m/sec and Mf=0.25 g/sec. It will be understood that the Mfa values quoted herein apply per linear centimeter of the nozzle orifice length L.

These Mfa limits can be transformed as follows for the case of steel with a density G of circa 8 g/cm3 to the expected layer thicknesses (d) of the melt on the wheel before separating into fibers:

Mfa=0.01 g/(m2*sec): d=(Mfa/G)*(m2*sec/U*Ld*sec)=⅛ *$10^{-2}$ mm

Mfa=100 g/(m2*sec): d=⅛ mm

Ideally with

Mfa=0.42 g/(m2*sec): d=0.0875 mm.

It is particularly surprising that it is possible, by providing an apparatus and a method with the above features, to generate metal strands and fibers with dimensions which can be controlled within relatively tight limits using a rotatable wheel with a smooth, polished planar, non-structured surface having a certain surface roughness. The copper wheels used for the experiments detailed below were polished prior to each experiment. It is expected that there is some correlation between the surface roughness and the width of the fibers.

A controller is preferably provided for keeping the speed of rotation of the wheel constant so that the surface speed of the wheel lies in the range from 40 to 60 m/s with a wheel of 20 cm or larger diameter of the external circumferential surface. The production of fiber material is a combination of the material flow from the nozzle and the speed of rotation of the rotatable wheel. If one succeeds in drastically reducing the metal flow from the nozzle then it is also possible to operate with lower speeds of rotation, i.e. surface speeds of the wheel. Accordingly a speed of rotation of 10 Hz with a wheel of 200 mm diameter is also entirely possible providing the amount of molten material issuing from the nozzle is correspondingly reduced. It has proved possible to generate microfibers at speeds of rotation of 60 Hz with a wheel of 200 mm diameter. A surface speed of 100 m/s of a copper wheel is close to the mechanical limit for a copper wheel of 200 mm diameter. However, higher speeds are possible if the material of the wheel is changed, for example speeds of up to 200 m/s for a stainless steel wheel of 200 mm diameter.

Controlling the surface speed of the wheel in this manner makes it possible to ensure the flow of metal from a rectangular orifice of fixed width, or from another suitable orifice can be reduced to a level at which metal fiber of the desired size can be produced.

Although a diameter of the wheel of 20 cm to 35 cm is preferred this is not critical and wheel diameters in the range from 1 to 100 cm can be used. A larger diameter of the circumferential surface of the rotating wheel increases the surface speed of the wheel if the speed of rotation is kept constant. Thus a larger diameter of the wheel results in a smaller width of the metal fibers at constant speed of rotation. The width of the opening of the slit of the nozzle in the circumferential direction of the wheel is preferably selected (for a rectangular nozzle opening or a crescent shaped opening) to lie in the range from 20 to 500 μm and especially in the range from 20 to 100 μm. These are currently the practical size ranges for the width of the nozzle opening. It is however possible that higher peripheral speeds of the wheel will enable greater widths or sizes of the nozzle opening for the production of microfibers. The maximum length of the slit corresponds to the width of the external circumferential surface of the wheel in a direction parallel to the axis of rotation thereof, i.e. is the same as or less than the width of the external circumferential surface of the wheel, e.g. several centimeter shorter than the width of the external circumferential surface of the wheel. In the examples given, the width of the slit was ca. 1 cm and the width of the wheel ca. 4 cm.

For the sake of completeness it should be noted that Liebermann who produced ribbons of 10 to 40 μm thickness used a nozzle with a circular orifice.

The temperature of the melt is preferably kept 100 to 400° C. greater than the melting point of the metal. As the viscosity of the melt reduces with increasing temperature of the melt the reduction in viscosity with increasing temperature must be borne in mind when selecting the operating parameters for a particular metal in order to ensure the rate of delivery of molten metal to the rotatable wheel is kept sufficiently low for fibers of the desired dimensions to be achieved. The viscosity of the melt also depends on the material of the melt.

In addition to the foregoing the pressure exerted on the melt upstream of the nozzle is controlled to be higher than the pressure prevailing in the melt spinning chamber by an amount in the range from 50 to 5000 mbar. Although the aim is to reduce the amount of melt delivered to the rotatable wheel so that the desired sizes of microfibers arise, it nevertheless proves possible, with a nozzle length of 10 mm, to process one gram of metal per second to microfibers, so that the process is industrially relevant.

The rotatable wheel is preferably temperature controlled, e.g. to a temperature in the range of −100° C. to +400° C.

The wheel is usually made of a metal, for example copper or stainless steel, or of a metal alloy or of a ceramic material or is a wheel of a base material having a layer or tire made of a metal or of a metal alloy or of a ceramic material or of graphite or a vapor deposited carbon, for example a copper wheel having a layer of graphite.

The wheel is preferably mounted to rotate within a chamber having an atmosphere, the atmosphere being at least one of air, an inert gas, nitrogen, or helium.

Moreover, the wheel is preferably mounted to rotate within a chamber having an atmosphere at a pressure corresponding to the ambient atmospheric pressure, or to a lower pressure than ambient pressure.

Generally speaking the thickness and width of the microfibers can be controlled by dispensing a metallic melt from a crucible standing under a pressure P through a rectangular slot of area A onto a rapidly rotating planar wheel. In this connection the following process parameters have been found to be the determining factors:

Mfa—the mass of liquid metal dispensed per unit of area per second onto the surface of the rotating wheel, should be controlled and kept very low, typically below 10 g/(m2*sec).

In detail it has been found that the width of the fibers can be set in that a lower value of Vm results in a lower width of the metal fibers Mfa can be set by adjusting the following process parameters:

U—the surface speed of rotating wheel B on which the metallic melt is deposited.

In the experiments U was varied between 18 and 60 m/sec and it was found that higher speeds resulted in a lower width of the fibers. Speeds between 10 and 100 m/sec are readily conceivable.

A—the aperture area of the slit of the rectangular slit of the crucible through which the metallic melt is distributed onto the surface of the wheel. Reducing the width of the slit in the circumferential direction of the wheel results in a reduced value of Vm. The width W of the slit can be selected to lie at a value between 10 and 500 μm.

T—the temperature of the melt. As noted above the viscosity of the melt sinks with increasing temperature. A lower viscosity results in a higher Vm under constant conditions. Hence controlling T allows Vm to be reduced. It must be borne in mind that T has to be selected in dependence on the metal that is being used. Temperatures in the range from 100 to 400° C. above the melting point of the metal being used have been found to be useful.

P—the excess pressure which is used to expel the melt through the nozzle opening of the crucible. A higher value of ΔP, i.e. of the pressure difference between the pressure acting on the melt in the crucible and the pressure prevailing within the processing chamber, results in a higher Vm, however it must be borne in mind that a narrow value of the width of the nozzle may require higher values of pressure ΔP to partly compensate for the reduction in Vm due to the narrower width. In the experiments conducted pressures ΔP between 50 and 2000 mbar were found to be useful.

It is not easy to understand or predict why the metallic melt is split up into microfibers if Mfa is appropriately selected. A possible academic explanation is as follows:

Dewetting of thin liquid films on solid supports may appear by two different mechanisms:

(i) heterogeneous hole nucleation due to defects in the liquid film imposed by surface defects such as surface roughness which act as nucleation sites for the liquid material, and (ii) spontaneous rupture of the liquid film under the influence of long range molecular forces, known as spinodal dewetting.

These forces can destabilize a thin film by causing surface fluctuations to grow exponentially. Rupture takes Place on a length scale corresponding to the wavelength of the surface undulation whose amplitude increases most rapidly till it reaches the thickness of the film, also called critical film thickness.

In the case of an ideally flat surface no heterogeneous hole nucleations due to defects is expected.

Therefore, for dewetting to occur, a reduced film thickness less than the critical film thickness of the liquid film on a flat substrates needs to be provided. In the case of a non-moving substrate, surface forces which appear on the air-liquid and liquid-solid interface pull undulations in the thin film which eventually cause dewetting, i.e. holes. Such dewetting occurs within microseconds.

For moving solid substrates such as in the case of a rotating wheel which gets coated by ejection of a metal liquid film through the opening of a crucible the situation is drastically different.

The ejection direction is perpendicular to the movement of the surface of a rotating wheel. Upon contact of the liquid film with the moving solid support two additional forces pull on the air-liquid and liquid-solid interface: a tangential traction forces which pulls the liquid film with the moving solid support and a centrifugal force which pulls vertically away from the solid interface. These two forces may be enormous since the circular movement of the solid support is in the range of 60 m/sec or more. The traction forces cause the film to spread thinly and eventually to dewet if the film thickness is less than the critical film thickness of the material. The centrifugal force pulls on the appearing surface film undulations and promotes the dewetting structure even more. Since the traction force and the centrifugal force are one dimensional forces which respectively act tangentially and vertically to the liquid film surface, the undulations appear in stripe pattern in the direction of the traction force. This process may take a time in the range of microseconds. The cooling rate of melt spinning is in the range of $10^4$-10 microseconds per 100 degree centigrade—rather 1-10 microseconds—considering the little material which needs to be cooled in case of microfiber fabrication. Therefore, cooling rate and spinodal dewetting cover similar time ranges! If the temperature of the liquid film drops below its melting temperature slower than the dewetting time, solidified microfibers are spun-off the wheel. Therefore, macroscopic long fibers with microscopic width are fabricated where the width of the fiber depend on the amount of liquid material which is cast onto the rotating wheel area per unit time. A defect on the surface of the rotating wheel, such as topographic domains or surface roughness act as a nucleation site for the liquid film in addition to the spinodal dewetting. Regular domains along the surface of the wheel and perpendicular to the rotation axis may support to form a more homogeneous distribution of the fiber width and length. In the case of conical shaped domains centrifugal forces will force the liquid film to accumulate at the tip of the cones. This will impact the shape and uniformity of such fabricated microfibers.

REFERENCES

Spinodal Dewetting in Liquid Crystal and Liquid Metal Films, Stephan Herminghaus, Karin Jacobs, Klaus Mecke, Joerg Bischof, Andreas Fery, Mohammed Ibn-Elhaj, Stefan Schlagowski: Science 1998, 282, 916

Dewetting of an Evaporating Thin Liquid Film: Heterogeneous Nucleation and Surface Instability, Uwe Thiele, Michael Mertig, and Wolfgang Pomp: Physical Review Letters 1997, 80, 2869.

Figure 3:
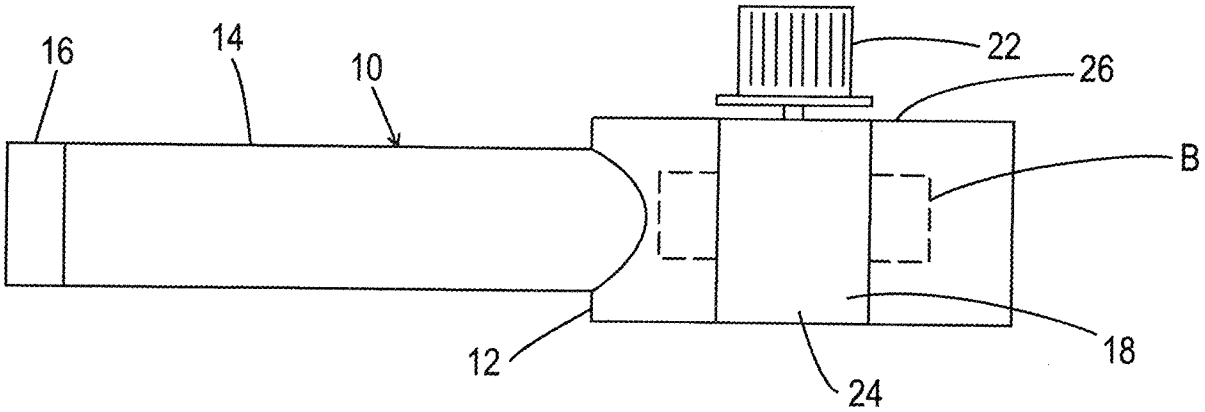
Figure 5:
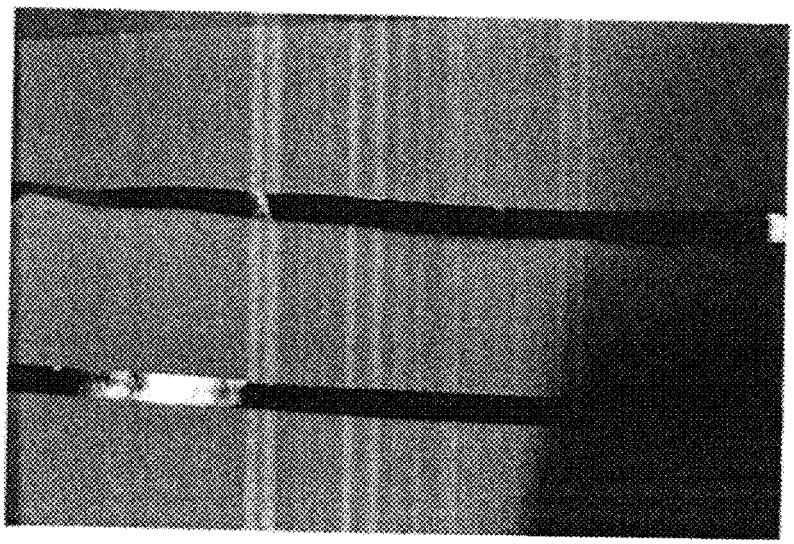
Figure 7:
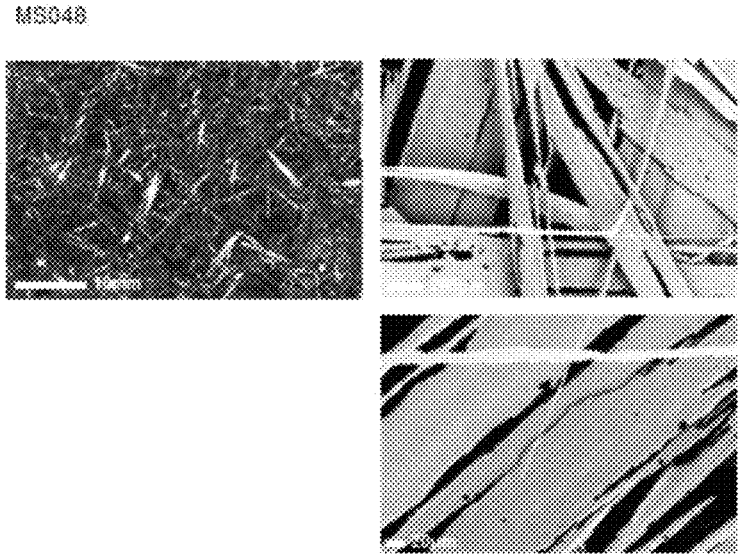
Figure 8:
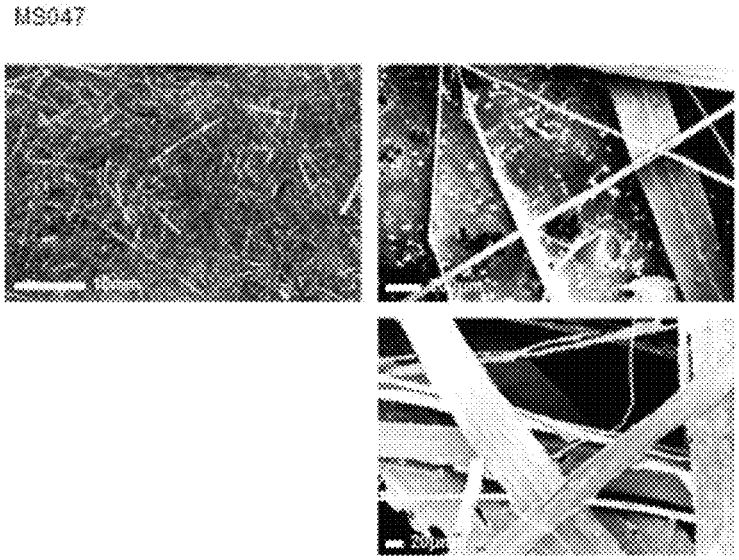
Figure 9:
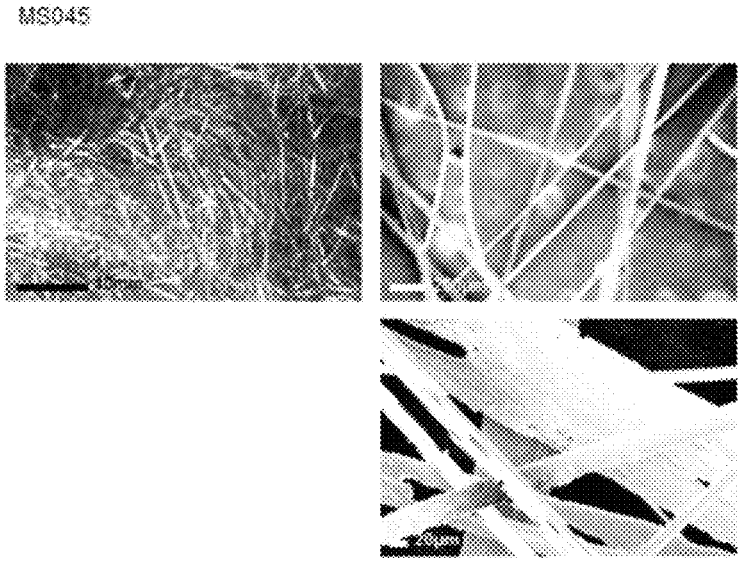
Figure 10:
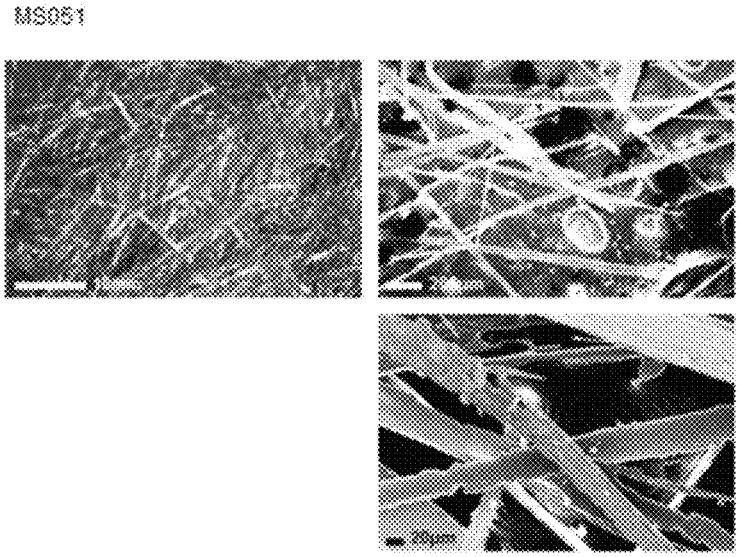
Figure 11:
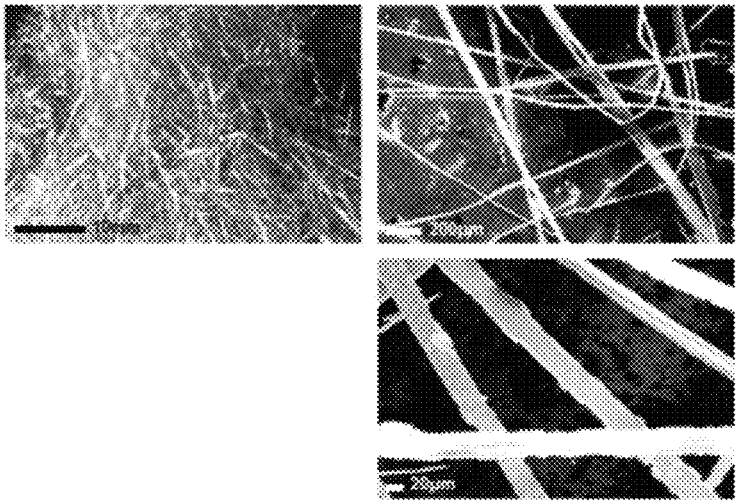
Figure 12:
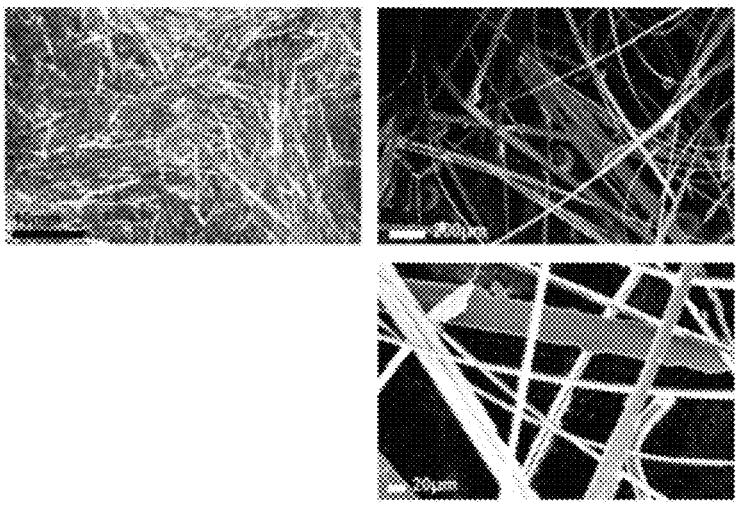

The invention will now be described in further detail and by way of example only with reference to the accompanying drawings and various examples of the method of the invention. In the drawings there are shown:

FIG. 1 a schematic illustration of the basic melt spinning process,

FIG. 2 a front view of the apparatus used for melt spinning equipped with the rotatable wheel of the present invention, FIG. 3 a detail view of the apparatus of FIG. 2 as seen in a front view with the housing removed, FIG. 4 a top view of the discharge orifice of the crucible with an explanatory sketch, FIG. 5 a photograph of a melt spun ribbon of an Fe40Ni40B20 alloy spun on a copper wheel of 200 mm diameter rotating at 30 Hz, comparative example 1, FIG. 6 a table showing important parameters for sixteen experiments comprising one comparative example and fifteen inventive examples, FIG. 7 one photograph (top left) and two SEM images top and bottom right) for fibers produced in the experiment of Example 2 with the scale bars in the photograph indicating a length of 10 mm and the scale bars for the top and bottom SEM images indicating lengths of 200 μm and 20 μm respectively, FIG. 8 one photograph (top left) and two SEM images top and bottom right) for fibers produced in the experiment of Example 3 with the scale bars in the photograph indicating a length of 10 mm and the scale bars for the top and bottom SEM images indicating lengths of 200 μm and 20 μm respectively, FIG. 9 one photograph (top left) and two SEM images top and bottom right) for fibers produced in the experiment of Example 4 with the scale bars in the photograph indicating a length of 10 mm and the scale bars for the top and bottom SEM images indicating lengths of 200 μm and 20 μm respectively, FIG. 10 one photograph (top left) and two SEM images top and bottom right) for fibers produced in the experiment of Example 5 with the scale bars in the photograph indicating a length of 10 mm and the scale bars for the top and bottom SEM images indicating lengths of 200 μm and 20 μm respectively, FIG. 11 one photograph (top left) and two SEM images top and bottom right) for fibers produced in the experiment of Example 6 with the scale bars in the photograph indicating a length of 10 mm and the scale bars for the top and bottom SEM images indicating lengths of 200 μm and 20 μm respectively, FIG. 12 one photograph (top left) and two SEM images top and bottom right) for fibers produced in the experiment of Example 7 with the scale bars in the photograph indicating a length of 10 mm and the scale bars for the top and bottom SEM images indicating lengths of 200 μm and 20 μm respectively, FIG. 13 two SEM images for fibers produced in the experiment of Example 8, with the images being taken at different positions of the sample and with the scale bars in the left and right hand images indicating lengths of 30 μm and 20 μm respectively.

Turning now to the schematic drawing of the melt spinning process shown in FIG. 1 it can be seen that the metal A to be spun is heated in a crucible K by an electrical heating device I. A gas pressure P presses the molten metal through the nozzle N of the crucible K onto the rotating wheel B. The wheel B has a planar external circumferential surface (S), which is flat in a direction parallel to the axis of rotation of the wheel (B). I.e. the circumferential surface S of the wheel corresponds to a surface of revolution obtained by rotating a straight line in a circle about an axis of rotation parallel to the straight line. As shown in FIG. 4 the nozzle N of the crucible K, which is typically made of boron nitride, has a nozzle opening O of rectangular shape. From the schematic diagram of FIG. 4 it can be seen that the length direction L of the nozzle opening is oriented transversely to the circumferential direction C of the circumferential surface S of the wheel B and extends over a substantial part of the axial width of the circumferential surface of the wheel, and in a practical example over at least most of the axial width of the wheel, so that the nozzle opening distributes molten metal across the axial width of the surface of the wheel B. The width W of the slot can be chosen within relatively wide limits, e.g. 500 μm and 10 μm to control the rate of flow of the molten metal from the nozzle N onto the structured surface S of the wheel B. When the width W is relatively large a relatively higher flow rate for the molten metal onto the structured surface of the wheel B is obtained and, for a given speed of the wheel, the strands produced are of relatively large cross-section. As the width W is reduced, which is achieved by substituting one crucible K for another one with the desired nozzle width W, the flow rate of the molten metal onto the structured circumferential surface S of the wheel B is reduced and, for the same speed of rotation of the wheel, the strands produced are relatively smaller in cross-section.

The pressure P applied to the molten metal can also be used to change the flow rate. Clearly a relatively large pressure leads to a higher flow rate than a relatively lower pressure. A minimum pressure P is always required in order to force the molten metal through the nozzle N, as gravity alone is not normally sufficient to ensure adequate flow, particularly with a relatively small width W of the nozzle opening. In fact this is advantageous because otherwise some form of valve would be necessary and a valve for regulating the flow of molten metal is technically challenging. It should be noted that the pressure difference ΔP between the pressure applied to the melt and the pressure prevailing in the chamber 12 is dependent on the metal used and on the width of the nozzle opening in the circumferential direction. It is also dependent on the length of the nozzle opening in a direction parallel to the axis of rotation of the wheel. The length of the nozzle opening can be varied within wide limits. For laboratory experiments values of 10 to 12 mm have been found useful. In production much greater lengths could be selected in dependence on the axial width of the circumferential surface of the wheel.

The actual apparatus used is shown in FIGS. 2 and 3. Apart from the design of the wheel B the apparatus shown in FIGS. 2 and 3 is basically a commercially available melt spinner obtainable from the company Edmund Buehler GmbH, Hechingen, Germany. It consists of a metallic chamber 10 having a cylindrical portion 12 and a tangentially extending collection tube 14 with a closable port 16 at the end remote from the cylindrical portion 12. The crucible K with the electrical heating system I and the gas pressure supply P are mounted within a short cylindrical extension 18 of the chamber 10 above the cylindrical portion 12 and are provided with the necessary supply lines for a pressurized gas such as argon, for electrical power and control of the gas flow valve determining the pressure P, for the power of the heating system I and for the monitoring of parameters such as gas pressure and temperature of the melt. The wheel B is mounted on the inside of and concentric to the cylindrical portion 12 and is supported by bearings (not shown) on an axle 20 driven by an electric motor 22 flanged to the rear of the cylindrical portion 12 (see FIG. 3). The front side 24 of the cylindrical portion, i.e. the side 26 opposite the drive motor 22 is made of glass so that the spinning process can be observed and filmed by a high speed camera. The chamber 10 can be evacuated by a vacuum pump via an evacuation stub 28 and can be supplied with a flow of an inert or reactive gas via a further feed stub 30. Thus a desired atmosphere at a desired temperature and pressure can be provided within the chamber 10.

The cover for closing the port 16 can be a hinged or removable glass cover permitting the material collected in the cylindrical extension 18 to be observed, removed and filmed as required. In all experiments the copper wheel was not cooled.

The following experiments were conducted:

EXAMPLE 1—COMPARATIVE EXAMPLE

In the first experiment melt spun ribbons were generated on a standard copper wheel B with a diameter of 200 mm and a smooth circumferential surface 32 (indicated at S n FIG. 1 and seen in plan view in FIG. 3) having the shape of a right cylinder. A melt of Fe 40Ni40B20 is formed by the heating system I within the boron nitride crucible K. The crucible K has a slit orifice with nominal dimensions, length L=10 mm and width W=400 μm. Once the metal has melted gas pressure is applied to the molten gas by the pressure source P to expel the molten metal through the orifice and onto the copper wheel B. The copper wheel B was rotated by the drive motor at a surface speed of 18.8 m/s. The mass of the metal sample was ca. 10 g. As shown in FIG. 5, a single continuous ribbon was generated, which had a length of >1 m, a typical width of 9.3+1−0.1 mm, and a typical thickness of 42+1−2 microns. FIG. 5 shows that the ribbons manufactured in this way are of good quality However they are of much larger width and thickness than the dimensions aimed at in the present invention and thus the example is classified as a failed example.

In the following examples will be given of fibers produced by melt spinning using a smooth flat wheel and an Fe40Ni40B20 metallic glass (examples 3 to 7 and 9 to 14), for stainless steel (V2A example 8) as well as for Zn and Al (examples 15 and 16). Where reference is made to the median width this value is obtained in accordance with the usual definition. In all cases the thickness of the majority of the fibers was less than 5 μm. As yet no attempts have been made to more accurately determine the thicknesses

EXAMPLE 2—INVENTIVE EXAMPLE

| | |
|---|---|
| Material: Fe40Ni40B20 | Experiment MS048 |
| Nominal length of nozzle opening | 10 mm |
| Nominal width of nozzle opening | 400 μm |
| Temp of wheel | RT (~23° C.) |
| Gas in chamber | Argon |
| Pressure in chamber 12 | 400 mbar |
| Temp. of gas in chamber 12 | RT |
| Ejection temperature | 1400° C. |
| Ejection pressure | 600 mbar |
| Surface speed of wheel | 59.4 m/s |
| Diameter of wheel | 200 mm |
| Distance between nozzle and wheel | 0.3 mm |
| Width of the resultant fibers | Max 1296 μm, min 6.3 μm |
| Thickness of the resultant fibers | <5 μm |

EXAMPLE 3—INVENTIVE EXAMPLE

| | |
|---|---|
| Material: FE40Ni40B20 | Experiment MS047 |
| Nominal length of nozzle opening | 10 mm |
| Nominal width of nozzle opening | 200 μm |
| Temp of wheel | RT (~23° C.) |
| Gas in chamber | Argon |
| Pressure in chamber 12 | 400 mbar |
| Temp. of gas in chamber 12 | RT |
| Ejection temperature | 1400° C. |
| Ejection pressure | 600 mbar |
| Surface speed of wheel | 59.4 m/s |
| Diameter of wheel | 200 mm |
| Distance between nozzle and wheel | 0.3 mm |
| Width of the resultant fibers | Max 335 μm, min 3 μm |
| Thickness of the resultant fibers | <5 μm |

EXAMPLE 4—INVENTIVE EXAMPLE

| | |
|---|---|
| Material: Fe40Ni40B0 | Experiment MS045 |
| Nominal length of nozzle opening | 10 mm |
| Nominal width of nozzle opening | 100 μm |
| Temp of wheel | RT (~23° C.) |
| Gas in chamber | Argon |
| Pressure in chamber 12 | 400 mbar |
| Temp. of gas in chamber 12 | RT |
| Ejection temperature | 1400° C. |
| Ejection pressure | 800 mbar |
| Surface speed of wheel | 59.4 m/s |
| Diameter of wheel | 200 mm |
| Distance between nozzle and wheel | 0.3 mm |
| Width of the resultant fibers | Max 216.1 μm, min 3.1 μm |
| Thickness of the resultant fibers | <5 μm |

EXAMPLE 5—INVENTIVE EXAMPLE

| | |
|---|---|
| Material: Fe40Ni40B20 | Experiment MS051 |
| Nominal length of nozzle opening | 10 mm |
| Nominal width of nozzle opening | 75 μm |
| Temp of wheel | RT (~23° C.) |
| Gas in chamber | Argon |
| Pressure in chamber 12 | 400 mbar |
| Temp. of gas in chamber 12 | RT |
| Ejection temperature | 1400° C. |
| Ejection pressure | 1000 mbar |
| Surface speed of wheel | 59.4 m/s |
| Diameter of wheel | 200 mm |
| Distance between nozzle and wheel | 0.3 mm |
| Width of the resultant fibers | Max 94 μm, min 2.3 μm |
| Thickness of the resultant fibers | <5 μm |

EXAMPLE 6—INVENTIVE EXAMPLE

| | |
|---|---|
| Material: Fe40Ni40B20 | Experiment MS050 |
| Nominal length of nozzle opening | 10 mm |
| Nominal width of nozzle opening | 50 μm |
| Temp of wheel | RT (~23° C.) |
| Gas in chamber | Argon |
| Pressure in chamber 12 | 400 mbar |
| Temp. of gas in chamber 12 | RT |
| Ejection temperature | 1400° C. |
| Ejection pressure | 1400 mbar |
| Surface speed of wheel | 59.4 m/s |
| Diameter of wheel | 200 mm |
| Distance between nozzle and wheel | 0.3 mm |
| Width of the resultant fibers | Max 148.3 μm, min 2.7 μm |
| Thickness of the resultant fibers | <5 μm |

EXAMPLE 7—INVENTIVE EXAMPLE

| | |
|---|---|
| Material: Fe40Ni40B20 | Experiment MS049 |
| Nominal length of nozzle opening | 10 mm |
| Nominal width of nozzle opening | 25 μm |
| Temp of wheel | RT (~23° C.) |
| Gas in chamber | Argon |
| Pressure in chamber 12 | 400 mbar |
| Temp. of gas in chamber 12 | RT |
| Ejection temperature | 1400° C. |
| Ejection pressure | 1900 mbar |
| Surface speed of wheel | 59.4 m/s |
| Diameter of wheel | 200 mm |
| Distance between nozzle and wheel | 0.3 mm |
| Width of the resultant fibers | Max 180.7 μm, min 2.1 μm |
| Thickness of the resultant fibers | <5 μm |

EXAMPLE 8—INVENTIVE EXAMPLE

| | |
|---|---|
| Material: Stainless steel V2A | Experiment MS058 |
| Nominal length of nozzle opening | 10 mm |
| Nominal width of nozzle opening | 75 μm |
| Temp of wheel | RT (~23° C.) |
| Gas in chamber | Argon |
| Pressure in chamber 12 | 400 mbar |
| Temp. of gas in chamber 12 | RT |
| Ejection temperature | 1550° C. |
| Ejection pressure | 1200 mbar |
| Sirface speed of wheel | 59.4 m/s95 Hz |
| Diameter of wheel | 200 mm |
| Distance between nozzle and wheel | 0.3 mm |

-continued

| | |
|---|---|
| Width of the resultant fibers | Max 143.9 μm, min 2.3 μm |
| Thickness of the resultant fibers | <5 μm |

The values for both the comparative example 1 and for the inventive examples 2 to 8 are summarized—together with other relevant values—in the Table of FIG. 6 classified by the experiment number. Further inventive examples 9 to 16 are included in the table of FIG. 6. Where available SEM micrographs and photographs of the relevant fibers are shown in FIGS. 7 to 13 and identified by the Experiment number (MS plus three digits).

The Table of FIG. 6 also includes mean values for the width of the microfibers that are produced.

Although the spacing between the nozzle opening and the wheel was 300 μm in the Examples given experiments have shown that choosing spacings between 100 and 300 mm; has not had any measurable influence on the microfibers produced.

In all experiments the diameter of the wheel was 200 mm.

The invention claimed is:

1. An apparatus for producing elongate microfibers of metal, of metallic glasses or of inorganic material, the apparatus comprising:

a rotatable wheel comprising a planar external circumferential surface with a width, wherein the width is flat in a direction parallel to an axis of rotation of the wheel, and wherein the rotatable wheel is configured to be temperature controlled to a temperature in a range of −100° C. to +200° C.;

at least one nozzle comprising a nozzle opening configured for directing a molten material onto the circumferential surface, with the at least one nozzle defining a rectangular cross section and a width of a slit of the nozzle opening in the circumferential direction of the wheel, wherein the width of the nozzle is in the range from 20 μm to 100 μm, and wherein a length of the nozzle opening corresponds to the width of the planar external circumferential surface;

a collection means positioned adjacent to the circumferential surface and configured for collecting solidified fibers of material formed on the circumferential surface from the molten material and separated from the circumferential surface by centrifugal force generated by rotation of the wheel; and a further apparatus that is configured to control a gas pressure applied to the molten material which moves the molten material through the nozzle opening and delivers it to the circumferential surface of the rotatable wheel, and configured to regulate a mass flow of molten material down to a level at which microfibers of the material are formed on the rotatable wheel by controlling and keeping the mass flow per unit area of the wheel surface of the molten material which is deposited per unit of area onto the circumferential surface of the rotatable wheel in the range from 0.01 g/($m^2$*sec) to 100 g/(m2*sec) for a surface speed of rotation of the wheel in the range from 10 m/sec to 100_m/sec.

2. The apparatus in accordance with claim 1, wherein the at least one nozzle has a length transverse to the circumferential surface of the wheel which is greater than the width.

3. The apparatus in accordance with claim 2 in which the length of the slit corresponds to the width of the external circumferential surface of the wheel in a direction parallel to the axis of rotation thereof.

4. The apparatus in accordance with claim 1, wherein the mass flow per unit area of the wheel surface of the molten material which is deposited per unit of area onto the circumferential surface of the rotatable wheel is controlled and kept in the range from between 0.1 and 5050 g/($m^2$*sec) for a surface speed of rotation of the wheel in the range from 10 to 100 m/sec.

5. The apparatus in accordance with claim 4, wherein the mass flow per unit area of the wheel surface of the molten material which is deposited per unit of area onto the circumferential surface of the rotatable wheel is controlled and kept in the range from between 0.2 and 0.30 g/($m^2$*sec) for a surface speed of rotation of the wheel in the range from 10 to 100 m/sec.

6. The apparatus in accordance with claim 4, wherein the mass flow per unit area of the wheel surface of the molten material which is deposited per unit of area onto the circumferential surface of the rotatable wheel is controlled and kept around 0.4 g/($m^2$*sec) for a surface speed of rotation of the wheel in the range from 10 to 100 m/sec.

7. The apparatus in accordance with claim 1, wherein a controller is provided that is configured to keep a speed of rotation of the wheel constant so that a surface speed of the wheel is in the range from 40 to 60 m/s.

8. The apparatus in accordance with claim 1 in which the temperature of the melt is kept 100 to 400° C. greater than a melting point of the material.

9. The apparatus in accordance with claim 1 in which the pressure exerted on the melt upstream of the at least one nozzle is controlled to be higher than a pressure prevailing in the apparatus by an amount in the range of 0 to 5000 mbar.

10. The apparatus in accordance with claim 1, wherein the wheel is made of a metal or of a metal alloy or of a ceramic material or of graphite or is a wheel of a base material having a layer or tire made of a metal or of a metal alloy or of a ceramic material or of graphite or a vapor deposited carbon.

11. The apparatus in accordance with claim 1, wherein the wheel is made of copper or stainless steel or is a copper wheel having a layer of graphite formed thereon.

12. The apparatus in accordance with claim 1, wherein said wheel is mounted to rotate within a chamber having an atmosphere, the atmosphere being at least one of air, nitrogen, helium and other inert gasses.

13. The apparatus in accordance with claim 1, wherein said wheel is mounted to rotate within a chamber having an atmosphere at a pressure corresponding to the ambient atmospheric pressure, or to a lower pressure than ambient pressure.

14. A method for producing elongate microfibers of metal, or metallic glasses or of inorganic material having a median width of 50 μm or less, a thickness of 5 μm or less and a length at least ten times greater than said width, the method comprising the steps of:

directing a molten material through a nozzle onto a planar external circumferential surface of a rotating wheel, wherein the nozzle comprises a nozzle opening directing the molten material onto the circumferential surface, wherein the nozzle defines a rectangular cross section and a width of a slit of the nozzle opening in the circumferential direction of the wheel being in the range from 10 μm to 500 μm, by applying a gas pressure to the molten material to move the molten materials through the nozzle opening and deliver the molten materials to the circumferential surface of the rotatable wheel, wherein the molten material moves through the nozzle and is deposited per unit of area onto the circumferential surface of the rotatable wheel in the range from 0.01 g/($m^2$*sec) to 100 g/($m^2$*sec) for a surface speed of rotation of the wheel in the range from 10 m/sec to 100 m/sec to concentrate the deposited molten material to produce the elongate microfibers of the material on the rotatable wheel; and collecting solidified fibers formed on the circumferential surface from the molten material and separated from the circumferential surface by centrifugal force generated by rotation of the wheel.

15. The method in accordance with claim 14, wherein the flow rate of metal is set to a level at which the elongate microfibers have a width of less than or equal to 200 μm.

16. The method in accordance with claim 14, wherein the fibers have a thickness of less than or equal to 5 μm.

* * * * *